United States Patent [19]

Minnich

[11] B 3,990,656

[45] Nov. 9, 1976

[54] POP-UP FIN

[75] Inventor: Violet C. Minnich, Huntsville, Ala.

[73] Assignee: The United States of America as represented by the Secretary of the Army, Washington, D.C.

[22] Filed: Sept. 30, 1974

[21] Appl. No.: 510,521

[44] Published under the second Trial Voluntary Protest Program on March 2, 1976 as document No. B 510,521.

[52] U.S. Cl. ..... 244/3.27
[51] Int. Cl.[2] ..... F42B 13/32
[58] Field of Search ..... 244/3.27, 3.28

[56] References Cited

UNITED STATES PATENTS

| | | | |
|---|---|---|---|
| 3,188,957 | 6/1965 | Petre | 244/3.27 |
| 3,826,448 | 7/1974 | Burk, Jr. | 244/3.27 X |

FOREIGN PATENTS OR APPLICATIONS

| | | | |
|---|---|---|---|
| 1,203,647 | 10/1965 | Germany | 244/3.27 |

*Primary Examiner*—Verlin R. Pendegrass
*Attorney, Agent, or Firm*—Nathan Edelberg; Jack W. Voigt; James T. Deaton

[57] ABSTRACT

A fin construction for small missiles that includes two members that are pivotally secured together at one end with the other end of one of the members being pivotally secured to a structure and the other end of the other member being slidably mounted on a rod with tension springs biasing the two members together to form a generally triangular shape of a fin. The two members are maintained in a flattened out relation inside an opening of the missile housing by securing means around a plurality of the fins located around the periphery of the missile which securing means maintains the fins in a retracted position until the missile is launched from a launch tube at which time the securing means is removed to allow the tension springs to bias the fin members into a triangular fin shape for stabilizing the rocket.

7 Claims, 5 Drawing Figures

POP-UP FIN

BACKGROUND OF THE INVENTION

In small missiles, there is a need for a lightweight fin arrangement and yet an arrangement that will provide the necessary stability for flight. There is also a need for a fin arrangement in which in the closed position the fins require less space than that required by fins that are made in a completely solid configuration.

Therefore, it is an object of this invention to provide a fin arrangement for a small missile in which the fins in the closed position require less space than that required by a completely solid fin configuration.

Another object of this invention is to provide a small missile with a lightweight fin arrangement.

Still another object of this invention is to provide a lightweight fin arrangement which also provides the necessary stability for flight of the missile.

SUMMARY OF THE INVENTION

In accordance with this invention, a missile with pop-out fins is provided that includes a plurality of fins mounted around the periphery of said missile and folded inside the outer periphery of the missile and held in this position prior to launching. Each fin includes two members that are pivotally mounted together at one end with one end of one of the members being pivoted to the missile housing and the free end of the other member having a sling that is slidably mounted about a rod secured in the body structure. Tension spring means is secured to the pivotal members to bias them into an outward fin shape or triangular shaped position when the missile has been launched. This compact and simple fin arrangement is designed for lightweight missiles but yet a fin arrangement that gives stability to the missile.

DESCRIPTION OF THE PREFERRED EMBODIMENT

Figure 1:
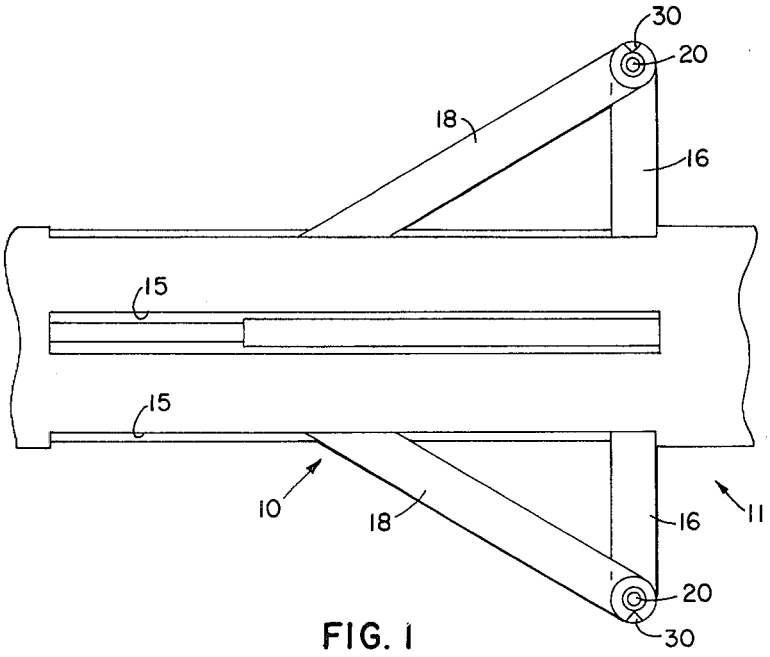
FIG. 1 is a perspective view partially cut away of a missile with extended fins according to this invention.

Referring now to the drawing, missile 10 has a plurality of folding fins 11 for stabilization of the missile in flight. The missile can contain from three to four of these fins in order to stabilize the missile in flight.

Referring now to FIGS. 2–5, missile housing 12 has a bolt 14 secured within slot 15 for each set of fins. Each set of fins includes a first blade 16 and a second blade 18 that are dovetailed and pivotally connected at 20. First blade 16 is also pivotally secured to housing 12 by pivot 22. Blade 18 has sling 24 mounted at one end for guiding the distal end of blade 18 along bolt 14. The distal end of blade 18 also has a pin 26 mounted therethrough. A pair of springs 28 are mounted on opposite sides of blades 16 and 18 by pin 26 and pivot connection 22. Springs 28 are mounted in tension when the blades are in the folded position illustrated in FIG. 2.

Figure 2:
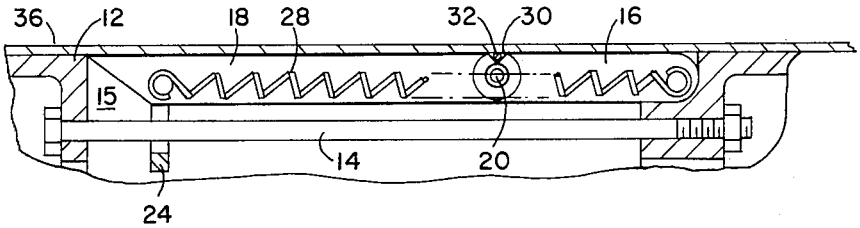
FIG. 2 is a view partially in section illustrating the folded position of one of the fins when in a launching position.
Figure 3:
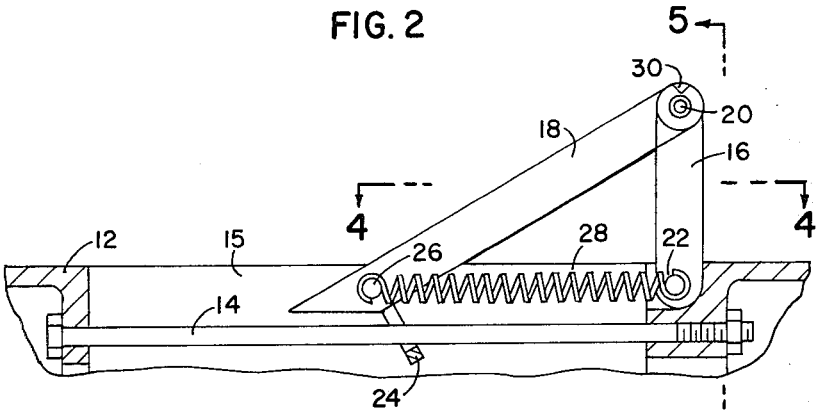
FIG. 3 is a partial sectional view illustrating a fin in the extended position.

To hold the blades in the closed position within the opening in the structure of missile 10, blades 16 and 18 may have slots 30 as illustrated in FIG. 2 to hold the assembly in the inward position with wire or string 32 which would be cut or severed at the time of leaving the tube as the blades are biased outwardly by springs 28. The center of springs 28 are slightly below the center of pivot 20 so that springs 28 always bias blade 16 and 18 to an outward and extended position as illustrated in FIGS. 1 and 3. Other means for securing the fins in the folded position may be used such as a cover over the fins which would be retracted in the breech prior to launch of the missile or the cylinder around the missile could be used to hold the fins in the inward position until they exit the launch tube. Also, other means of securing the blades in the inward position could be used and will be obvious to those skilled in this art.

Figure 4:
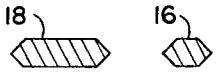
FIG. 4 is a sectional view taken along line 4—4 of FIG. 3.
Figure 5:
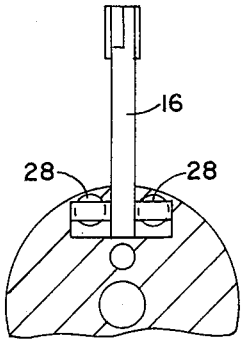
FIG. 5 is a view along line 5—5 of FIG. 3.

The structurally tapered leading and trailing edges of blades 16 and 18 are illustrated by FIG. 4 that is taken along section line 4—4 of FIG. 3. This configuration allows blades 16 and 18 to render the stabilizing action required for small missiles.

In operation, missile 10 is mounted in launch tube 36 (see FIG. 2) and when missile 10 is fired from launch tube 36, springs 28 bias blades 16 and 18 into the outward stabilizing position as illustrated in FIG. 3 to stabilize the missile. The folding type fins of this invention which are made of two blades simulate the complete solid fin configuration in the open position and provide stabilization of the missile.

I claim:

1. A missile having a pop-up fin comprising an elongated slot in an opening of said missile housing, a blade pivotally mounted at one end of said slot to said missile, a second blade pivotally mounted at one end to the other end of said first blade, the other end of said second blade having means thereon for slidably mounting and guiding said other end of said second blade along a longitudinal path relative to means secured within said missile, and spring means in tension mounted at said other end of said second blade and at said pivotal mounting at said one end of said first blade to bias said first and second blades outwardly and cause said other end of said second blade to slide along said means secured within said missile to cause said blades to be extended into a triangular like shape of a fin.

2. A missile as set forth in claim 1, wherein said tension means includes a pair of springs mounted on opposite sides of said first and second blades.

3. A missile as set forth in claim 2, wherein said guide means in said missile housing includes a bolt extending the length of said slot and said guide means on said second blade includes a sling around said bolt.

4. A missile as set forth in claim 3, wherein the leading edge of said second blade is tapered and the trailing edge of said first blade is tapered.

5. A missile as set forth in claim 4, wherein said missile has a plurality of said fins mounted around the periphery thereof and means securing said fins in a retracted position within said missile.

6. A missile as set forth in claim 5, wherein said means securing said fins in said position within said missile includes slots in said first and second blades with means wrapped in said slot to be severed when said missile is launched from a launching tube.

7. A missile as set forth in claim 6, wherein the trailing edge of said second blade is tapered and the leading edge of said first blade is tapered.

* * * * *